United States Patent [19]

Sanford

[11] Patent Number: 4,462,135

[45] Date of Patent: Jul. 31, 1984

[54] CLEANING AND ABRASIVE SCRUBBERS AND METHOD FOR THEIR PREPARATION

[76] Inventor: Howard R. Sanford, 348 E. 400 South, Springville, Utah 84663

[21] Appl. No.: 460,171

[22] Filed: Jan. 24, 1983

[51] Int. Cl.[3] ..... A47L 13/16

[52] U.S. Cl. ..... 15/105; 15/209 C

[58] Field of Search ..... 15/209 B, 209 C, 105

[56] References Cited

U.S. PATENT DOCUMENTS

| | | | |
|---|---|---|---|
| 1,689,207 | 10/1928 | Kingman | 15/209 B |
| 1,963,529 | 6/1934 | Protz | 15/209 C |
| 2,948,911 | 8/1960 | Steiner | 15/209 B |

FOREIGN PATENT DOCUMENTS

| | | | |
|---|---|---|---|
| 953389 | 12/1949 | France | 15/209 C |
| 1233600 | 5/1960 | France | 15/209 B |
| 120217 | 7/1927 | Switzerland | 15/209 B |
| 727874 | 4/1955 | United Kingdom | 15/209 B |

*Primary Examiner*—Chris K. Moore

[57] ABSTRACT

An improved exteriorally hand held cleaning and abrasive scrubber which is capable of providing both a cleaning and an abrasive action, comprising an instrument made up of a hollow cone shaped cleaning section joined at its apex to the apex of a hollow cone shaped abrasive section, said cleaning section being made up of numerous layers of netting mesh prepared from special polymeric material, said abrasive section being covered by a layer of said netting mesh and containing a plurality of coils of an abrasive solid.

20 Claims, 10 Drawing Figures

CLEANING AND ABRASIVE SCRUBBERS AND METHOD FOR THEIR PREPARATION

BACKGROUND OF THE INVENTION

1. Field of the Invention

This invention relates to a new and improved cleaning and abrasive scrubber and its preparation. More particularly, the invention relates to a new type of exteriorally hand held cleaning and abrasive scrubber which provides both a cleaning and an abrasive action, and a method for its preparation from an extruded tubular netting mesh prepared from special polymeric material.

Specifically, the invention provides a new and improved hand held cleaning and abrasive scrubber which is capable of providing both a cleaning and an abrasive action, comprising an instrument made up of a hollow cone shaped cleaning section joined at its apex to the apex of a hollow cone shaped abrasive section, said cleaning section being made up of numerous layers of netting mesh prepared from special polymeric material, said abrasive section being covered by a layer of said netting mesh and containing a plurality of coils of an abrasive solid.

The invention further provides a process for preparing the said scrubber comprising forming a cleaning section by selecting an extruded tubular netting mesh prepared from a special polymeric material and having a tubular cross section and two open ends, drawing one end of the tubular netting mesh back over the center of the tubular mesh to form a multiple ply tubular netting mesh, then concentrically folding upon itself a plurality of times so as to form a soft cylindrical bun comprising the cleaning section, extending the multiple ply tubular mesh through the cylindrical cleaning section as a center core for the abrasive section, a coiled abrasive solid encircles the center core a plurality of times, then drawing the center core outwardly and around the said coiled abrasive solid and toward the cleanjng section, said center core being tightly secured to the mid to bottom portion of the cleaning section.

2. Prior Art

Heretofore a variety of cleaning and cleansing scrubbers have been used to remove dirt and unwanted surface material from body surfaces, walls, sinks, dishes, vegetables, fruits, etc. Such materials have included terry wash clothes, soft and brittle brushes for cleaning the human body while bathing or showering, and various cleaning pads, scouring pads, sponges, steel, brass and copper wool, etc. have been used to clean dirt and unwanted surface material from walls, sinks, dishes, pots, pans, and the like. Separate abrasive instruments, such as scouring pads and steel wool, have been used to remove dirt and debris from dishes, vegetables and the like, where the dirt and debri have been strongly attached or deeply embedded in the object to be cleaned.

The above-noted cleaning instruments have a great many disadvantages which have limited their use in many applications. Many of the products, for example, become water logged and it is difficult to remove the water containing the removed dirt from the scrubber. In addition, such products which retain the water often develop unpleasant odors, as well as become a place for breeding of bacteria, germs, mold, etc. In addition, many of the products have very low strength and are easily destroyed after they have been used several times. In addition, many of the products are difficult to hold and, after extensive periods of use, cause considerably strain in the hand and wrist. Furthermore, some of the said cleaning scrubbers are harmfully abrasive to modern surfaces, such as TEFLON coatings. Further, in many cases the cleaning problems have been such that a variety of different types of cleaning agents and abrasive agents must be kept on hand to effect the necessary cleaning.

It is an object of the invention, therefore, to provide a new and improved type of cleaning and abrasive scrubber which solves many of the above-noted problems. It is a further object to provide a new type of cleaning instrument which provides both cleaning and abrasive action in the same scrubber. It is a further object to provide a cleaning and abrasive scrubber which is easily held by the hand and operates without undue strain on the hand or fingers. It is a further object to provide a new type of cleaning and cleansing scrubber which does not retain water used in cleaning and scrubbing and is far less absorbent than prior known scrubbers. It is a further object to provide a new cleaning and abrasive scrubber which is very strong and tough and can be used repeatedly without undergoing deterioration. It is a further object to provide a new scrubber which provides a long lasting abrasive action and which can be used on all types of surfaces. It is a further object to provide a new scrubber which is harmless to the new type of plastic surfaces on pots and pans, such as the containers coated with TEFLON. It is a further object to provide a new scrubber which is decorative and can be used as part of the decore of the bathroom or kitchen, etc. These and other objects of the invention will be apparent from the following detailed description thereof.

SUMMARY OF THE INVENTION

It has now been discovered that these and other objects can be accomplished by the new cleaning and abrasive scrubbers of the present invention comprising an instrument made up of a hollow cone shaped cleaning section joined at its apex to the apex of a hollow substantially cone shaped abrasive section, said cleaning section comprising a hollow cone shaped soft bun the outer walls of which are made up of a plurality of plys of an extruded tubular netting mesh prepared from a strong flexible polymer, preferably of the group consisting of addition polymers of olefinic monomers, and polyamides of polycarboxylic acids and polyamines, said plys of tubular netting mesh being concentrically folded upon itself numerous times to form the said walls of the soft bun, said plys of tubular mesh being extended through the open center of the hollow bun to act as a center core to receive the abrasive section, said abrasive section comprising numerous coils of an abrasive solid encircled around the center core to form a hollow abrasive bun, the said center core being extended outwardly and around the abrasive solid and toward the cleaning section and being tightly and securely attached to the outer bottom portion of the cleaning section so as to form the cone shape of the cleaning and abrasive sections and to secure the abrasive section to the bottom of the cleaning section.

It has been found that these new cleaning and abrasive scrubbers provide many unexpected advantages over the prior known scrubbers. The new scrubbers, for example, possess ability to provide both cleaning action and abrasive action, and it is not necessary to utilize two separate instruments for both actions. In addition, the new scrubbers possess a special mesh netting scrubbing surface which does not retain the water, soap and other cleaning solutions used in the cleaning and scrubbing action, but permits the easy removal of such materials as by shaking, squeezing or just allowing the solutions to drain therefrom. This special advantage allows the scrubbers to remain fresh and clean and free from bacteria growth which is known to accumulate in the prior known foam and cloth scrubbers. Because of the unique structural arrangement using the strong plastic mesh, the new scrubbers are extremely tough and durable and can be used numerous times without tearing or deteriorating as with many of the prior known cleaning and scouring materials. Further advantage is also found in the fact that the abrasive action originating in the use of the abrasive section of the scrubber, is also very long lasting and, despite its tough nature, can be used on many of the new types of plastic surfaces, such as the TEFLON coated pots and pans, without destroying that sensitive surface. The new scrubbers are also particularly attractive as they can be securely held by the hand for extended periods of time without undue strain on the hand or fingers. The new scrubbers can also be prepared, particularly by use of the netting skirts, to form very attractive instruments that can be used as part of the decor of the bathroom or kitchen and need not be hidden away after use as with the prior known scrubbers.

A further advantage of the present invention is that the new cleaning and abrasive scrubbers can be easily prepared from readily available raw materials and at an economic price. The new scrubbers are preferably prepared from extruded tubular netting mesh which has been prepared from special strong and flexible polymeric material. Extruded tubular netting mesh of this type, and particularly those prepared from polyethylene, have been used for the covering of meat and poultry carcasses and are readily available in industry.

In the preferred method of preparation, one first prepares a multilayered extruded tubular netting mesh which is open at both ends. This can be prepared by simply drawing one extruded tubular netting over another tubular netting mesh until the desired number of plys have been obtained. Preferably, the multi-layered extruded tubular netting mesh is prepared by selecting a given length of the desired extruded tubular netting mesh which is open at both ends, and then drawing one end of the netting mesh back over itself one half the length of the said tubular netting mesh to form the desired multi-layer tubular netting mesh. This can be repeated as often as desired to obtain the tubular netting mesh having the number of plys for the covering of the abrasive section and the decorative skirt.

The multi-layered extruded tubular netting mesh prepared as noted above is then concentrically folded upon itself a plurality of times so as to form a soft bun for the cleaning section. The remaining portion of the multi-layer tubular netting mesh is therefore extended through the hollow center of the soft bun to form a center core to receive the abrasive section.

The abrasive section is then prepared by placing the desired open mesh abrasive solid which has been coiled a plurality of times, around the center core so as to form a soft cylindrical abrasive bun. The end portion of the center core comprising the multi-layer tubular netting mesh is then extended outwardly and around the abrasive solid material and toward the cleaning section, and the center core is then extended outwardly and around the abrasive solid material and toward the cleaning section, and the center core is then drawn and securely attached to the outer portion of the cleaning section so as to form a cone shaped cleaning section and abrasive section and to secure the abrasive section to the bottom of the cleaning section, a decorative skirt is formed by the end portion of the extended center core. The multi-layer netting mesh skirt is securely attached to the cleaning section preferably by means of a nylon band or suitable closure.

Figure 1:
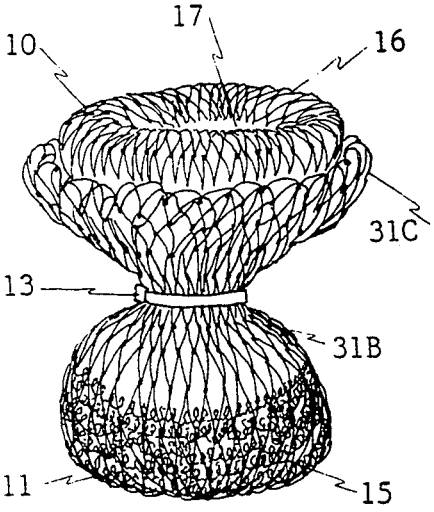
FIG. 1 is a perspective representation of the new cleaning and abrasive scrubber of the present invention.

The assembled cleaning and abrasive scrubber shown in FIG. 1 is made up of the cleaning section 10 composed of a plurality of layers of netting mesh as represented by 16 in cone shape with the hollow of the cone at 17. The abrasive section 11 contains abrasive coils 15 covered by the outer layer of netting mesh 31B which is drawn over the abrasive section and securely tied to the cleaning section by band 13.

Figure 2:
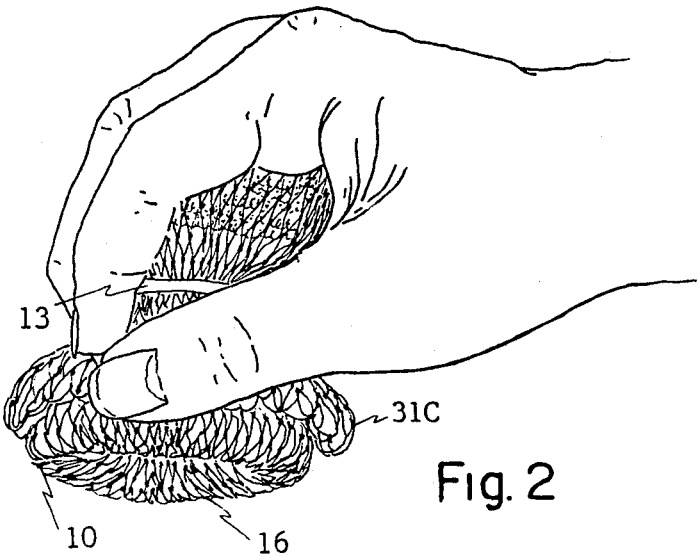
FIG. 2 is a perspective view of the new scrubber illustrating how the scrubber can be held in the hand to particularly utilize the cleaning section of the scrubber.
Figure 3:
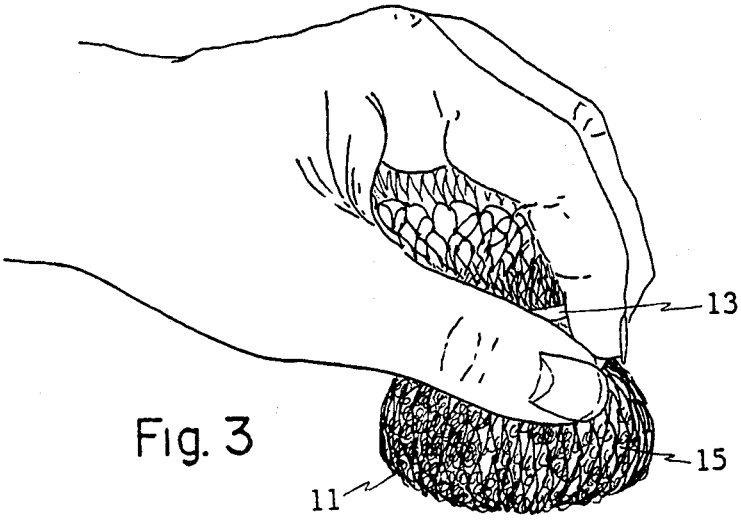
FIG. 3 is a perspective view of the new scrubber illustrating how the scrubber can be held in the hand to utilize the abrasive section of the scrubber.

The ease with which the new cleaning and abrasive scrubber can be held in the hand for utilization of the cleaning section is shown in FIG. 2, and the ease with which the new cleaning and abrasive scrubber can be held in the hand for utilization of the abrasive section is illustrated in FIG. 3.

Figure 4:
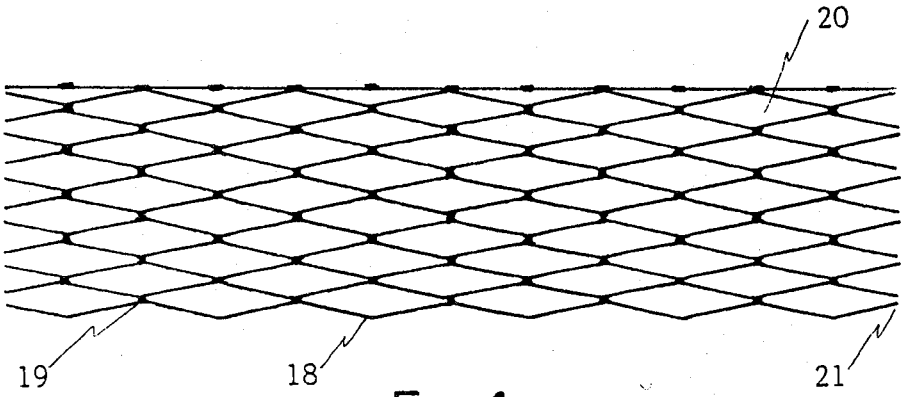
FIG. 4 is an enlarged fragmentary cross section taken along line 4—4 of FIG. 5 illustrating a single sheet of the netting mesh stretched perpendicular to the filaments to show the bonding of the filaments and a representative spacing of the bonds.

The netting mesh that can be used in making the new products of the invention is illustrated in FIG. 4, wherein 21 represents the mesh in stretched position. The fine polymeric filaments used in making the netting are represented by 18 with 19 representing the spot bonding of the filaments to form the open mesh 20.

Figure 5:
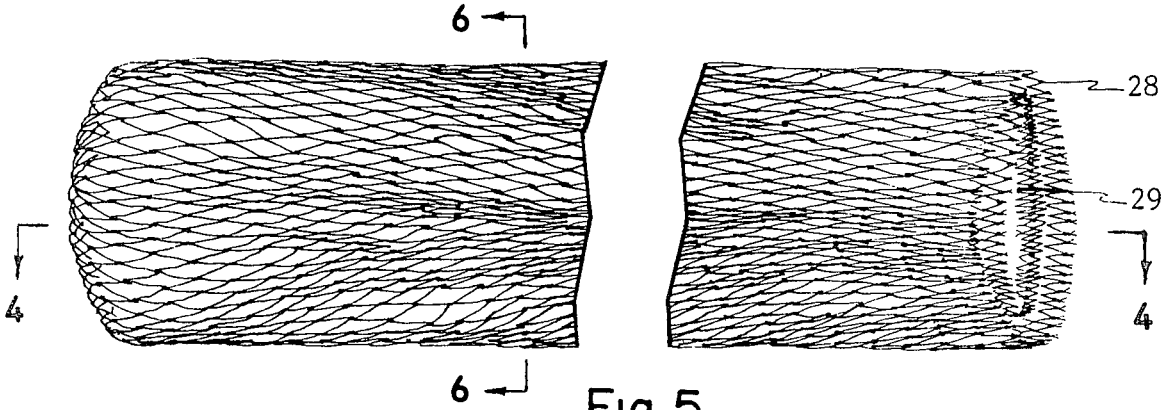
FIG. 5 is a perspective view of the tubular netting mesh which has a portion of the tube drawn over itself to form two ply tubing netting mesh.
Figure 6:
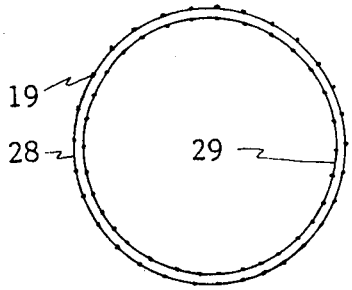
FIG. 6 is a cross sectional view taken along line 6—6 of FIG. 5 showing two layers of netting.

The tubular netting mesh wherein one end has been drawn over half the length of the tubular mesh to form a two ply tubular mesh is shown in FIG. 5. The outer layer of mesh is represented by 28 and the inner layer represented by 29. FIG. 6 is a cross sectional view of the two ply tubular mesh. In FIG. 6, line 28 represents the outer layer of filaments and 29 the inner layer with 19 representing the spot bonding of the filaments.

Figure 7:
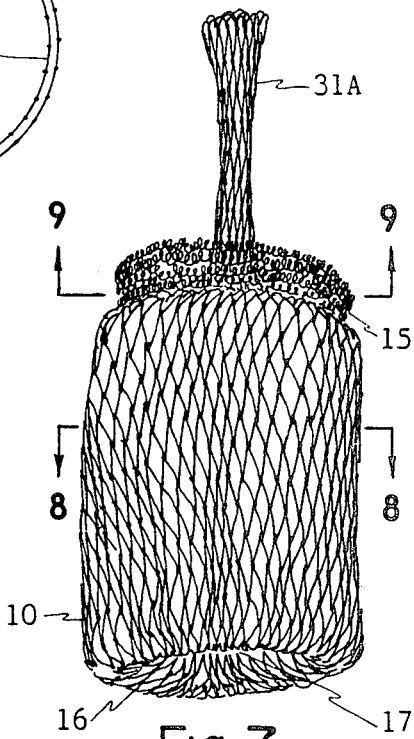
FIG. 7 is a perspective view of the two ply mesh which has been concentrically folded upon itself numerous times; the folded end of the two ply mesh extending through the center of the numerous layers to form the center core for the abrasive solid which is illustrated encircling the core.

FIG. 7 illustrates the product formed by the concentric folding upon itself with the netting mesh extension through the center of the cleaning section to form the center core 31A, with 10 representing the cleaning section, 16 the multi-layers of netting and 17 the hollow center of the cleaning section with abrasive solid 15, encircling center core 31A.

Figure 8:
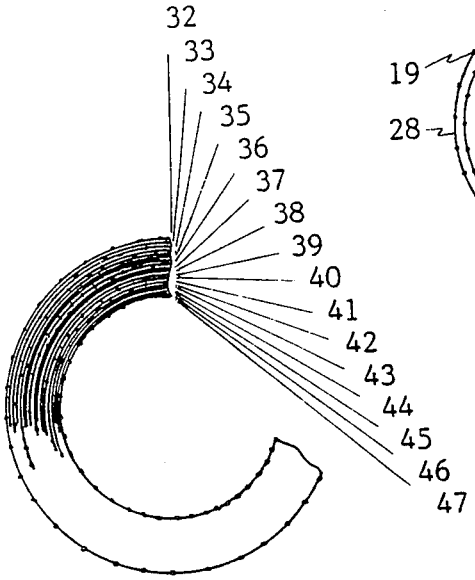
FIG. 8 is a fragmentary cross sectional view taken along line 8—8 of FIG. 7 illustrating numerous plys.

FIG. 8 is a fragmentary cross sectional view of FIG. 7 and represents the multi-layer tubular netting mesh obtained after the 2 ply netting mesh has been folded back upon itself numerous times, the 16 different layers of mesh being represented by lines 32 to 47.

Figure 9:
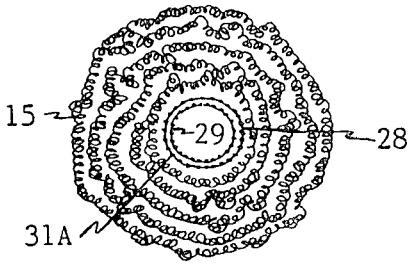
FIG. 9 is a cross sectional view taken along line 9—9 of FIG. 7 illustrating coils of the abrasive solid encircling core.

FIG. 9 illustrates the abrasive solid used in the abrasive section, 15 represents a section of the metallic shavings used as the abrasive solid, 31A represents center mesh core.

Figure 10:
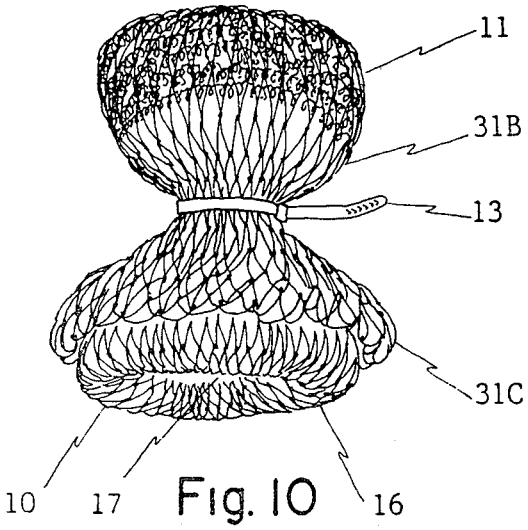
FIG. 10 is a perspective view of the assembled cleaning and abrasive scrubber showing how the tubular netting mesh skirt has been tightly joined to the bottom of the cleaning section by means of the nylon band.

FIG. 10 represents the assembled cleaning and abrasive scrubber with 31B representing the center core netting that is drawn down over the abrasive section and tightly bound to the bottom of the cleaning section by means of nylon band 13, with the extra center core netting passing down over the outside of the cleaning section to form a decorative skirt 31C.

DETAILED DESCRIPTION OF THE INVENTION

The extruded tubular netting mesh or fabric used in the preparation of the new cleaning and abrasive scrubbers of the present invention can be of any suitable type. Preferably the tubular netting has a maximum transverse expanded diameter of about 8 to 16 inches with the contracted minimum diameter on the order of about ½ inch. The tubular netting is preferably open at both ends so that it can be easily utilized in making the multi-ply netting for the preparation of the cleaning section. The netting is prepared from fine filaments of polymeric material having a thickness preferably varying from about 10 to 18 mils. The netting is prepared from as many as 50 to 200 such filaments which appear to cross over each other at a 45° angle and are bonded at junction points at intervals varying from about 3/16 to ½ inch, depending upon the type of netting or fabric desired. It is important that the bonding of the filaments at the indicated intervals be of such a nature as to securely attach the filaments together and provide a strong netting for the cleaning action. The bonding is preferably accomplished by the extruding technique, heat sealing the filaments together or by use of appropriate adhesives. An example of netting that can be used in the process of the invention is illustrated in the drawing as FIG. 4.

The polymeric material used to prepare the above-noted netting mesh should be strong and flexible and durable against the cleaning and abrasive action to which the new scrubbers will be subjected. Preferred polymeric materials to be used include the addition of thermoplastic polymers of olefinic monomers, such as ethylene, propylene, butylene, and the like. This includes their homopolymers and copolymers of these monomers with other ethylenically unsaturated monomers where the copolymer contains at least 25% of the olefinic monomer. A preferred member of this group includes DuPont polyethylene netting mesh indentified as VEXAR.

Other polymeric material that can be used include the nylon type products prepared from reaction polycarboxylic acids with polyamines and suitable modifications thereof.

As noted above, the extruded tubular netting mesh is first formed into a multiple ply tubular netting mesh by drawing one end of the tubular netting mesh over itself back to the other end, and repeating the process until the tubular netting mesh has the desired number of plys. The number of plys selected will depend upon the type of product desired and its intended use. If a very strong and tough cleaning section is desired, it is generally preferred to utilize a tubular netting mesh having from 4 to 16 plys. A softer and more flexible cleaning section may be obtained by using smaller numbers of plys, say from 2 to 4.

After the desired thickness of layers of the extruded tubular netting mesh has been obtained, it can be used to produce the cylindrical soft bun comprising the cleaning section. This is accomplished by concentrically folding the extruded netting mesh upon itself until the desired density of bun has been obtained. Here again, the number of folds will depend upon the type of cleaning section to be obtained and the intended use. A large number of folds provides a very strong cleaning section with ability to retain liquid cleaning solution for a longer period of time than those with fewer number of plys. In general, cylindrical buns having the desired properties are obtained by use of from two to twenty folds, and more preferably, from six to eight folds.

The size of the folds will depend upon the size of the cleaning section desired. In most cases, folds varying from about 3 to 8 inches are generally sufficient.

The folded end of the multi layer extruded netting mesh then extends through the open center of the cylindrical soft bun, comprising the cleaning section, to form a center core to receive the abrasive section.

As noted, the abrasive section comprises a plurality of coils of an open mesh abrasive solid. This solid is preferably from 1 to 1½ inches thick and 2 to 2½ inches in width. The material itself is preferably a coiled product such as may be obtained from shavings of metals, such as steel, brass and copper. The solid itself must be hard enough to give the necessary abrasive action but still flexible enough to be coiled around the center core. The solids may be prepared from a variety of material that meet this requirement, such as metal, wood, plastic, and the like.

The number of coils of the abrasive solid to be contained in the abrasive section may vary over a considerable range depending upon the material and intended use. In general, from 20 to 50 coils should be sufficient to give the necessary abrasive action.

After the coiled abrasive solid has been placed around the center core, the core is extended outwardly and around the abrasive solid and toward the cleaning section to thus provide a protective covering for the abrasive solid. The end of the center core is then securely attached to the outer mid to bottom portion of the cleaning section. The said core can be securely attached by any suitable means, such as by a metal or plastic band. The band is preferably tightly bound around the core covering the bottom of the cleaning section so as to force the cleaning section into a conical shape with the band being at the apex of the cone.

The preparation of the cleaning and abrasive scrubbers of the present invention as exemplified by the scrubber shown in FIG. 1 of the drawing is illustrated below.

The material used to make the cleaning section comprises orange colored DuPont tubular VEXAR polythylene netting identified as Style#136V130-CAOG, or Amoco #1363. The VEXAR mesh comprises parallel polyethylene filaments of about 10 mils in thickness spot sealed together about every ½ inch to form a netting with the tubular cross-section of the netting at maximum expansion being about 12 inches in diameter.

An approximate six foot length of the above described netting was selected and one end passed over the center tubular netting so as to form a two ply netting of approximately 3 feet in length. The open ends of the two ply netting was then repeatedly folded back on itself in lengths of about 2½ inches to form a soft cylindrical bun of 8 folds or about 16 ply. When both walls are pressed together the bun would possess 32 ply of the said netting.

The remaining portion of the tubular netting mesh which makes up about 6 inches extends through the center of the abovenoted bun to act as a center core for the abrasive section. A string of metal coiled shavings having a thickness of 1–2 mills and width of 20 mills and a coiled diameter of ⅛ inch, and length of about 40 feet are coiled around the center mesh core to form about 45 coils of the said material. The extended portion of the center mesh core is then drawn outwardly and around the abrasive coils and backward toward the cleaning section. The center core is then tightly bound around the bottom of the cleaning section by means of a nylon cable tie, thus converting the cleaning section and the abrasive section into cone shaped instruments. About two inches of the center core which extends beyond the nylon tie remains free to act as a decorative skirt around the scrubber.

The new cleaning and abrasive scrubbers of the present invention can be utilized for a great many different applications. They can be used, for example, for cleaning and scrubbing the various parts of the body, for the cleaning and scrubbing of various instruments, pots and pans, cleaning of fruits and vegetables, and for various other applications which require a strong but flexible cleaning or abrasive instrument.

The invention may be embodied in other specific forms without departing from the spirit or essential characteristics thereof. The present embodiment is therefore considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. An improved exteriorally hand held cleaning and abrasive scrubber which is capable of providing both a cleaning and an abrasive action, comprising an instrument made up of a hollow cone shaped cleaning section joined at its apex to the apex of a hollow cone shaped abrasive section, said cleaning section being made up of numerous layers of netting mesh prepared from a strong, flexible and durable polymer, said abrasive section being covered by a layer of said netting mesh and containing a plurality of coils of an abrasive solid.

2. An exteriorally hand held cleaning and abrasive scrubber which is capable of providing both a cleaning and an abrasive action, comprising an instrument made up of a hollow cone shaped cleaning section joined at its apex to the apex of a hollow substantially cone shaped abrasive section, said cleaning section comprising a hollow cone shaped soft bun, the outer walls of which are made up of a plurality of plys of an extruded tubular netting mesh prepared form special polymeric material, said plys of tubular mesh being concentrically folded upon itself numerous times to form the said walls of the soft bun, the end of said plys of tubular mesh being extended through the open center of the hollow bun to act as a center core to receive the abrasive section, said abrasive section comprising numerous coils of an abrasive solid coiled around the center core to form a hollow abrasive bun, the said center core being extended outwardly and around the abrasive solid and toward the cleaning section and being tightly and securely attached to the outer bottom portion of the cleaning section so as to form the cone shapes of the cleaning and abrasive sections and to secure the abrasive section to the bottom portion of the cleaning section, the special polymeric material used in making the tubular netting mesh comprising a strong, flexible polymer of the group consisting of addition polymers of olefinic monomers, and polyamides of polycarboxylic acids and polyamides.

3. A cleaning and abrasive scrubber as defined in claim 2 wherein the extruded tubular netting mesh is prepared from polyethylene.

4. A cleaning and abrasive scrubber as defined in claim 2 wherein the extruded tubular netting mesh is prepared from polypropylene.

5. A cleaning and abrasive scrubber as defined in claim 2 wherein the extruded tubular netting mesh is prepared from a polyamide.

6. A cleaning and abrasive scrubber as defined in claim 2 wherein the number of plys of extruded netting mesh being concentrically folded upon itself varies from 2 to 20.

7. A cleaning and abrasive scrubber as defined in claim 2 wherein the plys of extruded netting mesh are concentrically folded upon itself from 2 to 20 times.

8. A cleaning and abrasive scrubber as defined in claim 2 wherein the extruded netting mesh has a mesh size varying from ¼ to ¾ inch.

9. A cleaning and abrasive scrubber as in claim 2 wherein the filaments in the extruded netting mesh have been bonded together about every ¼ to 1 inches.

10. A cleaning and abrasive scrubber as defined in claim 2 wherein the open mesh abrasive solid contained in the abrasive section comprises coils of metal shaving.

11. A cleaning and abrasive scrubber as defined in claim 2 wherein the open mesh abrasive solid contained in the abrasive section comprises coils of brass, steel and copper shavings.

12. A cleaning and abrasive scrubber as defined in claim 2 wherein the open mesh abrasive solid contained in the abrasive section comprises 20 to 50 coils of metal shavings having a thickness of between 1 and 2 mils.

13. A cleaning and abrasive scrubber as defined in claim 2 wherein the center core is securely attached around the bottom portion of the cleaning section by means of a nylon band.

14. A cleaning and abrasive scrubber as defined in claim 2 wherein the center core is extended beyond the point where it is securely attached to the cleaning section so as to form a decorative skirt around the cleaning section of the scrubber.

15. A cleaning and abrasive scrubber as defined in claim 2 wherein the extruded tubular netting mesh is colored.

16. A process for preparing a cleaning and abrasive scrubber which comprises forming a cleaning section by providing a predetermined length of tubular netting mesh formed of a material of the group consisting of addition polymers of olefinic monomers, and polyamides of polycarboxylic acids and polyamides, said tubular netting mesh having a tubular cross section and two open ends, drawing one end of the tubular netting mesh back over the center of the tubular netting mesh to form a multiple ply tubular netting mesh, then concentrically folding the multiple ply mesh upon itself a plurality of times so as to form a soft cylindrical bun comprising the cleaning section, a portion of the tubular netting mesh extending through the cylindrical cleaning section as a center core a plurality of times, then drawing the center core outwardly and around a coiled abrasive solid and toward the cleaning section, said center core being tightly secured to the mid to bottom portion of the cleaning section.

17. A process as in claim 16 wherein the extruded tubular netting mesh is prepared from polyethylene.

18. A process as in claim 16 wherein the number of plys of extruded netting mesh being concentrically folded upon itself varies from 2 to 20 times.

19. A process as in claim 16 wherein the plys of extruded netting mesh are concentrically folded upon itself from 2 to 20 times.

20. A process as in claim 16 wherein the abrasive solid in the abrasive section comprises 20 to 50 coils of metal shavings.

* * * * *